US007975442B1

(12) United States Patent
Frey

(10) Patent No.: US 7,975,442 B1
(45) Date of Patent: Jul. 12, 2011

(54) CONTROL OF MIGRATION OF COLD MANIFESTATION, FROM EXTERIOR, IN MULTIPLE GLAZED WINDOW OR DOOR SYSTEMS

(75) Inventor: John R. Frey, Riverside, CA (US)

(73) Assignee: International Aluminum Corporation, Monterey Park, CA (US)

( * ) Notice: Subject to any disclaimer, the term of this patent is extended or adjusted under 35 U.S.C. 154(b) by 0 days.

(21) Appl. No.: 12/460,086

(22) Filed: Jul. 15, 2009

(51) Int. Cl.
*E06B 3/68* (2006.01)

(52) U.S. Cl. ..... 52/204.6; 52/204.5; 52/235

(58) Field of Classification Search ..... 52/235, 52/717.02, 204.5, 204.6
See application file for complete search history.

(56) References Cited

U.S. PATENT DOCUMENTS 5,452,552 A * 9/1995 Ting ..... 52/235
5,579,616 A * 12/1996 Farag ..... 52/235
6,205,724 B1 * 3/2001 Garling et al. ..... 52/209
6,550,196 B2 * 4/2003 Braybrook ..... 52/235
7,134,247 B2 * 11/2006 Ting ..... 52/235
2002/0124499 A1 * 9/2002 Braybrook ..... 52/235
2007/0193205 A1 * 8/2007 Hill ..... 52/745.15
2010/0175339 A1 * 7/2010 Moriya et al. ..... 52/204.5

* cited by examiner

*Primary Examiner* — Eileen Lillis
*Assistant Examiner* — Alp Akbasli
(74) *Attorney, Agent, or Firm* — William W. Haefliger

(57) ABSTRACT

Apparatus to protect glazed window or door panels against cold manifestation effective migration via glazing panel edge defined gaps, there being spaced apart outer, intermediate and inner glazing panels, the apparatus comprising holder structure projecting longitudinally endwise radially inwardly in said gaps, the holder structure being laterally sidewardly elongated, first synthetic resinous material retained by the holder structure to face laterally in a gap toward opposed intermediate panel edges, the material adjustably located at a position relative to the opposed intermediate panel edges characterized in that cold manifestation migrating through the gap via said material is confined to migrate in the spacing between the outer and intermediate panels, at opposite sides of the gap.

2 Claims, 2 Drawing Sheets

Figure 1:
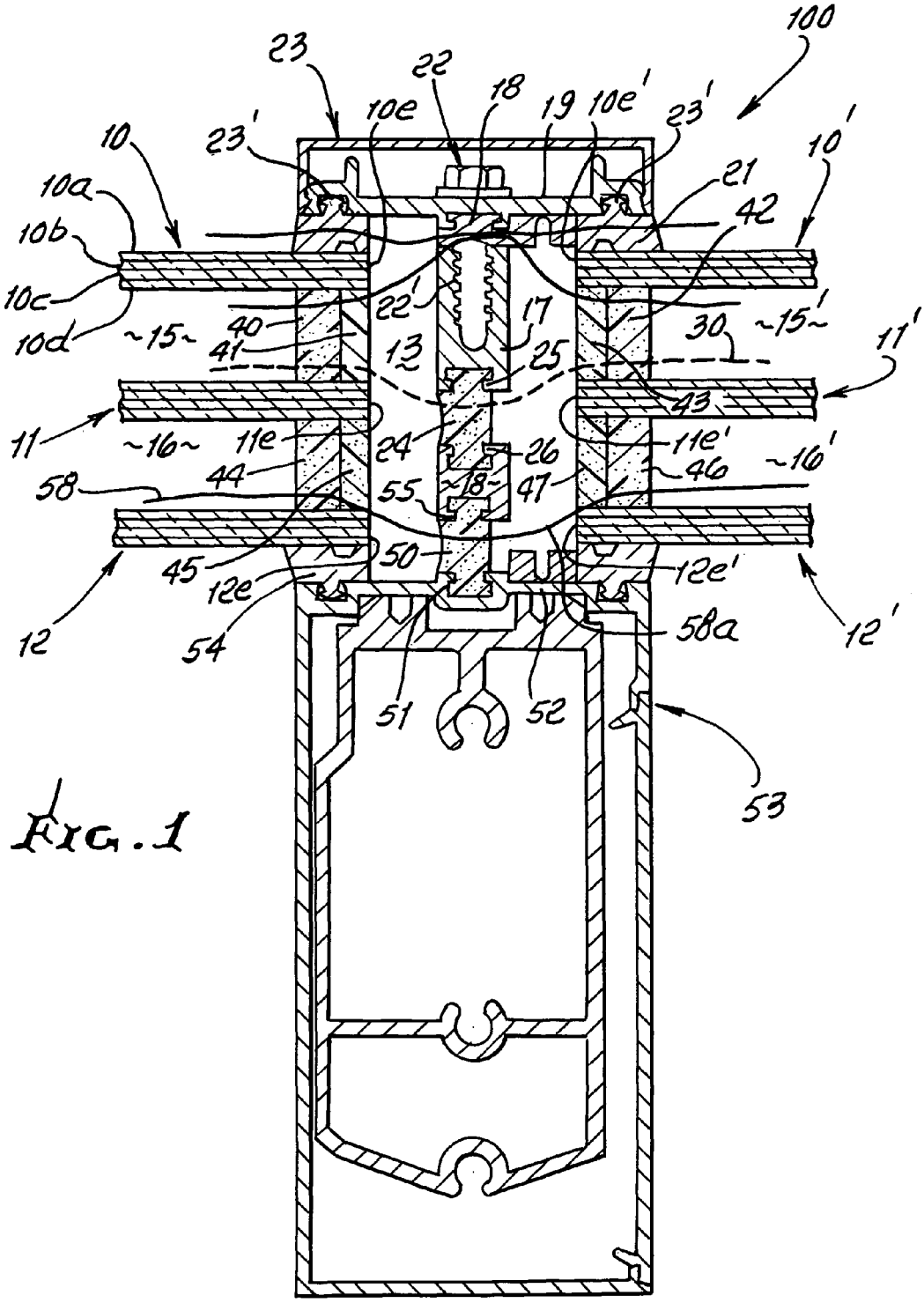

CONTROL OF MIGRATION OF COLD MANIFESTATION, FROM EXTERIOR, IN MULTIPLE GLAZED WINDOW OR DOOR SYSTEMS

BACKGROUND OF THE INVENTION

This invention relates generally to maintenance of insulation integrity of window and door multiple glazed insulation system; and more particularly to cold manifestation migration control at windows or doors having multiple glazings. The invention in particular addresses the problem of blocking of such cold manifestation migration from glazing exterior regions to glazing interior regions, in triple glazed environment.

It is found that, in triple glaze panel, curtain wall installations or systems, and where edgewise gaps are necessarily provided between triple panel sections, and with panel holding structure located at such gaps, cold manifestation migrates over time, via the gap, from the exterior toward the region adjacent the innermost glazing panel, compromising the insulative purpose of triple glazing. There is need for simple, effective apparatus obviating this condition, in order to preserve insulation integrity.

SUMMARY OF THE INVENTION

It is a major object of the invention to provide simple, effective cold manifestation migration control, or blocking means, as will appear. Basically the apparatus provides a migration flow path control so related, in position, to edges of glazing panels in a triple glazing system, that such migration will be deflected away from the innermost of the glazing panels. Such deflection is provided at the gap between edges of the panels, as for example is required for reception of panel retention structure, as will appear.

More particularly, the invention is typically embodied in conjunction with a glazing system having spaced apart outer, intermediate and inner glazing panels, and comprises:

a) holder structure projecting longitudinally endwise radially inwardly in said gap, b) first synthetic resinous material retained by such holder structure to face laterally in the gap, toward opposed intermediate panel edges, c) such material adjustably located at a position relative to the opposed intermediate panel edges characterized in that cold manifestation migrating through the gap via said material is confined to migrate in the spacings between the outer and intermediate panels, at opposite sides of the gap.

As will be seen, the holder structure typically includes oppositely projecting holders retaining the resinous material to project freely between terminals defined by the holders.

A further object is to locate the bulk of resinous metal projecting or extending in an inward direction in the gap beyond a lateral plane bisecting the intermediate panel or panels.

An added object is to locate the resinous material in the gap to be sidewardly spaced from the edges of the intermediate glazing panels adjacent the gap.

Yet another object is to provide second synthetic resinous material retained by the holder structure to face laterally in the gap toward opposed inner panel edges.

These and other objects and advantages of the invention, as well as the details of an illustrative embodiment, will be more fully understood from the following specification and drawings, in which:

DRAWING DESCRIPTION

Figure 2:
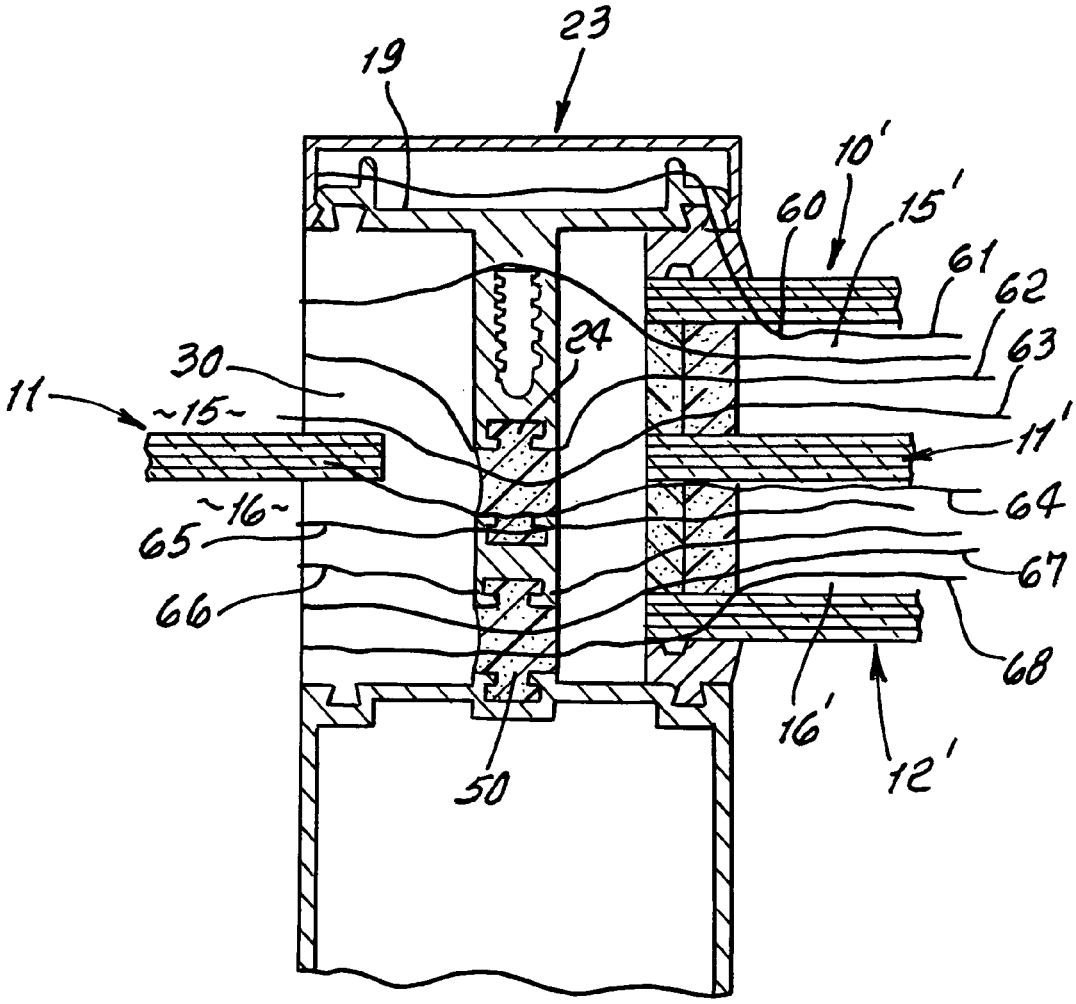

FIG. 1 is a section taken through a triple glazed wall or window assembly; and FIG. 2 is a view like FIG. 1, but showing isotherms.

DETAILED DESCRIPTION

In FIG. 1, a preferred triple glazed window or wall assembly 100 includes outer glazing panels 10 and 10'; intermediate glazing panels 11 and 11', and inner glazing panels 12 and 12'. Each panel may include sub-panels, as are indicated at 10*a*, 10*b*, 10*c*, and 10*d*, for panel 10.

Edges of the panels facing a gap 13 are indicated at 10*e* and 10'*e*; 11*e* and 11'*e*, and 12*e* and 12'*e*, Spaces between panels are identified as follows:

| Space | Between panels |
|---|---|
| 15 | 10 and 11 |
| 16 | 11 and 12 |
| 15' | 10' and 11' |
| 16' | 11' and 12' |

Panel holder structure is provided to project longitudinally endwise relatively inwardly in the gap 13. That structure may take the form of stems 17 and 18. Stem 17 is connected at 18 with a middle portion of a plate 19 that bridges the gap, at the outer sides of panels 10 and 11. Spacer 20 is provided between the plate and panel 10; and a spacer 21 is provided between the plate and panel 101. A fastener 22 extends through the plate to threadably connect at 22' to stem 17; and a cap 23 fits over the plate and fastener, as shown, with connection to the plate at 23'.

Stem 17 is endwise spaced from stem 18; and a first synthetic resinous body 24 is retained by the tongue and groove connections 25 and 26 to extend endwise therebetween in the gap. Body 24 faces laterally toward opposed edges 11*e* and 11'*e* of the intermediate panels.

The resinous material in body 24 is adjustably located at a position relative to the opposed panel edges characterized in that cold manifestation migrating into and through the gap, as for example via the material is constrained to migrate in the spaces 15 and 15'. See isotherm broken line 30, passing through 24 at a location intermediate 11*e* and 11'*e*, and dipping to pass through body 24, just below connection 25. If body 24 is shifted downwardly toward the plane of panels 12 and 12' by an amount which is about half the thickness of panel 11 or 11', the isotherm line migrating via space 15 deflects downwardly into the space 16', meaning that cold manifestation then migrates into that space, and then an unwanted cooling effect is transmitted via panel 12' to the building interior. As shown, connection 25 is intersected by a plane defined by surfaces of 11 and 11' adjacent spaces 15 and 11'. Also, the bulk of the body 24 between connections 25 and 26 extends in an inward direction beyond a lateral plane bisecting the panels 11 and 11', whereby the isotherm 30 extends, as shown.

In FIG. 1, insulative layers 40 and 41 extend between 10 and 11 as shown; insulative layers 42 and 43 extend between 10' and 11'; insulative layers 44 and 45 extend between layers 11 and 12; and insulative layers 46 and 47 extend between 11' and 12'

A second body 50 synthetic resinous materials, like body 24, is retained by the holder structure, to face laterally in the gap toward opposed inner panel edges 12*e* and 12'*e*. See body

50 connections to stem 18 at 55 and connection 51 to metallic end wall 52 of wall support structure 53. Spacer 54 is located between wall 52 and the lever surfaces of 12 and 12'. The lateral position relationship of body 50 to panels 12 and 12' is the same as the position relationship of body 24 to panels 11 and 11'. See also isotherm line 58 extending in spaces 16 and 16', and deflected downwardly at 58*a* to pass through body 50.

FIG. 2 shows isotherm lines 60-68 extending in spaces 16 and 16', and dipping in the gap to pass through bodies 24 and 50, whereby cold migration is kept in spaces 15' and 16'.

The resinous material may typically consists of polyurethane molded in position.

I claim:

1. Apparatus to protect glazed window or door panels against cold manifestation effective migration via glazing panel edge defined gaps, there being longitudinally spaced apart outer, intermediate and inner glazing panels that extend laterally, said apparatus comprising:

a) holder structure projecting longitudinally endwise radially inwardly in said gaps, b) first synthetic resinous material retained by said holder structure to face laterally in a gap toward opposed laterally spaced intermediate panel edges, c) said material adjustably located at a longitudinal position relative to said opposed intermediate panel edges characterized in that cold manifestation migrating through the gap via said material is confined to migrate in the spacing between the outer and intermediate panels, at opposite sides of the gap, d) the bulk of said first synthetic resinous material extending in a longitudinally inward direction beyond a lateral plane bisecting the intermediate panels, but remaining spaced from lateral planes defined by the outer and inner panels, e) and including second synthetic resinous material retained by said holder structure to face laterally in the gap toward opposed laterally spaced inner panel edges, said second resinous material spaced from said first resinous material and in longitudinally spaced alignment therewith.

2. The apparatus of claim 1 wherein the first and second resinous materials have substantially the same configuration.

* * * * *